United States Patent [19]

Gillette

[11] 4,382,350

[45] May 10, 1983

[54] HONING STONES

[75] Inventor: Robert H. Gillette, Angola, Ind.

[73] Assignee: Brammall, Inc., Angola, Ind.

[21] Appl. No.: 304,801

[22] Filed: Sep. 23, 1981

Related U.S. Application Data

[63] Continuation of Ser. No. 123,464, Feb. 21, 1980, abandoned.

[51] Int. Cl.[3] ..... B24D 5/00

[52] U.S. Cl. ..... 51/206.5; 51/206.4

[58] Field of Search ..... 51/204, 206.4, 206.5, 51/295, 388

[56] References Cited

U.S. PATENT DOCUMENTS

| | | | |
|---|---|---|---|
| 2,826,878 | 3/1958 | Linblad | 51/206.5 |
| 2,952,952 | 2/1959 | Stanhope | 51/204 |
| 3,822,515 | 7/1974 | Gillette . | |
| 3,995,400 | 12/1976 | Gillette . | |
| 4,212,137 | 7/1980 | Rue . | |

*Primary Examiner*—James G. Smith

*Attorney, Agent, or Firm*—Hill, Van Santen, Steadman, Chiara & Simpson

[57] ABSTRACT

An improved honing stone which minimizes the vibrations to which the abrasive material is subjected during the honing process. The improved stone has a hole formed in a dead zone thereof. A piece of resilient material is forced into the hole. When the stone is inserted into the honing machine, the resilient material retains and cushions the stone within the machine.

2 Claims, 4 Drawing Figures

HONING STONES

This is a continuation of application Ser. No. 123,464 filed Feb. 21, 1980, now abandoned.

BACKGROUND OF THE INVENTION

1. Field of the Invention

The invention relates to the field of holders for abrasives.

2. The Prior Art

It has long been known to use either metal or plastic insert-type holders for various forms of abrasive materials. It has also been known with respect to very hard abrasive materials to solder these materials, or weld them or otherwise bond them to a metal holder. Disadvantages of the prior art bonding, such as by sliver soldering, of the extra hard abrasives to a metal holder has made retention of the abrasive difficult and also vibrations set up during the honing process tended to shatter or crack the abrasive materials.

SUMMARY OF THE INVENTION

The inventive method comprises the steps of: applying a shock absorbing material to a very hard abrasive and mounting the very hard abrasive in a honing tool with retention and/or shock absorbing material.

One form of practicing the inventive method involves coating the very hard abrasive materials with a layer of polyurethane film. A second form of practicing the inventive method involves drilling a hole in the softer rear section of the abrasive material and sliding a piece of rubber or nylon or other such material through the hole in the abrasive. The length of material which is slid through the hole is long enough such that a selected amount of the material extends beyond each side of the abrasive. The abrasive is then clamped in the honing tool and the overhanging rubber or nylon material provides the necessary retention.

The inventive apparatus comprises a very hard abrasive coated with a plastic fiber or one having a piece of shock absorbing rubber or plastic inserted through a hole in the rear, softer, region of the stone.

DETAILED DESCRIPTION OF THE PREFERRED EMBODIMENTS

Not by way of limitation but by way of disclosing the best mode of practicing my invention, and by way of enabling one of skill in the art to practice my invention, there are shown in FIGS. 1 to 4 two alternate exemplary ways in which the inventive method be practiced and two alternate improved very hard honing stones.

Figure 1:
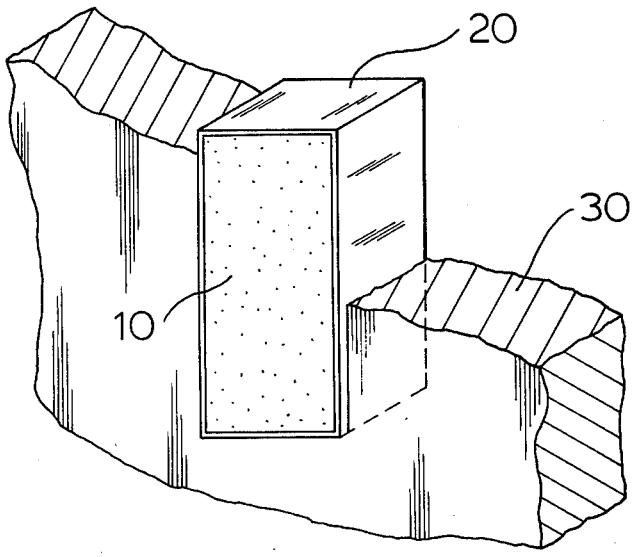
FIG. 1 is a fragmentary perspective view showing a very hard abrasive block coated with a layer of polyurethane film and supported in a honing machine.

In FIG. 1 a piece of very hard abrasive 10 has been coated with a polyurethane film 20. The piece of abrasive 10 having the film 20 is shown in FIG. 1 mounted in a honing machine 30. The film acts as a shock absorber to cushion the abrasive 10 from the vibrations set up by the honing machine 30 when the honing process is being carried out. The honing machine 30 may be a conventional machine of a type shown in U.S. Pat. No. 3,995,400.

I have discovered that if a very hard or super abrasive such as one found of diamond and cubic boron nitrite-sintered or one formed out of vitrified aluminum oxide or silicon carbide is first coated with a polyurethane film such as the film 20 before being inserted into the honing machine such as the machine 30 that the incidence of shattering of these very hard abrasives due to honing related vibrations is markedly reduced.

Figure 2:
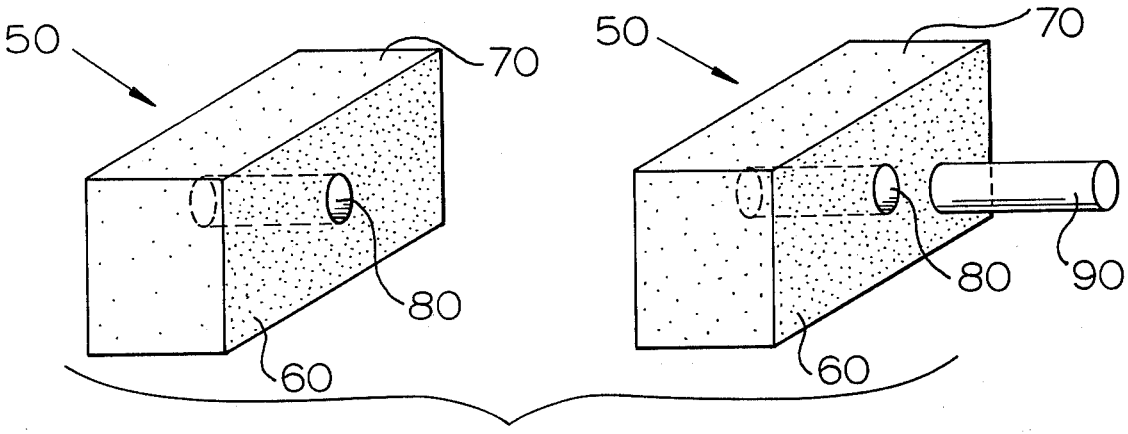
FIG. 2 shows the first steps of mounting retention material in a hole through the body of a very hard abrasive material.
Figure 3:
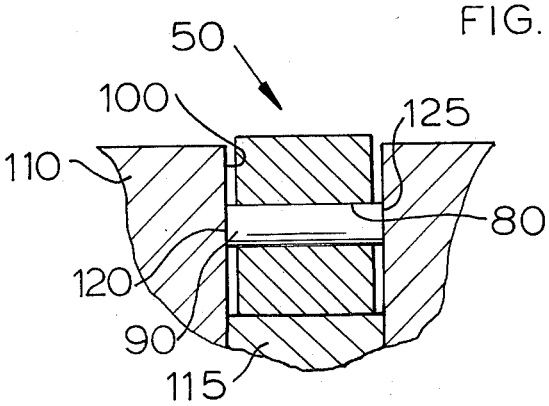
FIG. 3, an enlarged sectional view, shows the abrasive material with the retainer shown in FIG. 2 mounted in a honing machine.

Alternately, a very hard abrasive 50, as shown in FIG. 2, may be formed with a very hard front abrasive region and a softer rearwardly oriented dead region 70. In the dead region 70 a through hole 80 may be drilled through the softer material and a cylinder piece of retaining material 90 having a diameter corresponding to the diameter of the hole 80 may be inserted into the very hard abrasive 50. I have found that suitable materials for the cylindrical retaining member include rubber or plastics such as nylon. FIG. 3 shows a sectional view of the abrasive 50 mounted in a slot 100 of a conventional honing machine 110 having an expansion element 115. The retaining material 90 which is inserted in the boring 80 through the abrasive 50 is cut so as to be long enough as to have a first and a second end 120, 125, which extend outwardly laterally from the abrasive material 50. When the abrasive material 50 is slid into the slot 100 the overhanging ends 120, 125 of the retaining material 90 are located between the abrasive 50 and the slot 100 thereby firmly retaining the abrasive 50 in the tool holder.

Figure 4:
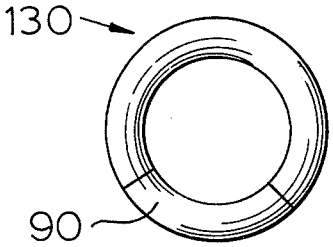
FIG. 4 illustrates apparatus for retaining the tool absorbing material for the method of FIGS. 2 and 3.

In FIG. 4 an O-ring 130 is shown with a region marked thereon corresponding to the retaining material 90. The region 90 may be cut from the O-ring 130 and inserted into the boring 80. The two end regions 120, 125 of the retaining member 90, depending on the length of the member 90, might be compressed and distorted by the sides of the slot 100 of the honing machine 110 when the abrasive 50 is inserted therein.

While various changes and modifications might be proposed by those skilled in the art, it will be understood that I wish to include within the claims of the patent warranted hereon all such changes and modifications as reasonably come within my contribution to the art.

I claim as my invention:

1. In combination an improved very hard abrasive of block shape which is to be mounted in a slot of a tool holder comprising a transverse opening formed through said very hard abrasive in a dead vibration zone, a piece of flexible material mounted in said transverse opening and with its ends overhanging from the sides of said very hard abrasive, said very hard abrasive and flexible material mounted in said slot of said tool holder with said overhanging ends of said flexible material deformed between the side walls of said slot and said very hard abrasive so as to firmly retain said abrasive in said tool holder and said flexible material has end faces which abut and are deformed within the slot of the tool holder.

2. A method of slidably mounting a very hard abrasive in a slot of a honing tool comprising the steps of drilling a hole through a rear dead zone of the abrasive material; inserting a piece of flexible retaining material through the hole with overhanging ends of the retaining material extending laterally out from each side of the body of the abrasive material a selected distance; and mounting the abrasive material, including the retaining material by pressing them into a slot of a honing machine with the retaining material being deformed and between the abrasive material and said side walls of the honing machine so as to cushion the abrasive from vibrations and to retain the abrasive therein and said flexible material has end faces which abut and are deformed within the slot of said honing machine.

* * * * *